US005397193A

United States Patent [19]

Kirk, III et al.

[11] Patent Number: 5,397,193

[45] Date of Patent: Mar. 14, 1995

[54] APPLICATOR WIPER

[75] Inventors: Karl D. Kirk, III, New York; Donald R. Lamond, Long Beach, both of N.Y.

[73] Assignee: L'Oreal S.A., Paris Cedex, France

[21] Appl. No.: 114,781

[22] Filed: Aug. 31, 1993

[51] Int. Cl.[6] ..... A46B 11/00; A45D 40/00

[52] U.S. Cl. ..... 401/122; 401/129

[58] Field of Search ..... 401/122, 129; 132/218

[56] References Cited

U.S. PATENT DOCUMENTS

| | | | |
|---|---|---|---|
| 1,029,077 | 6/1912 | Metzger | 401/18 |
| 1,905,399 | 4/1933 | Wagner | 15/160 |
| 2,131,539 | 9/1938 | Mureau | 132/317 |
| 2,576,550 | 11/1951 | Waters | 132/308 |
| 3,033,213 | 5/1962 | Joss et al. | 132/218 |
| 3,084,374 | 4/1963 | Ziegler | 401/122 |
| 3,214,782 | 11/1965 | Masters et al. | 401/122 |
| 3,262,461 | 7/1966 | Kambersky | 401/122 |
| 3,316,922 | 5/1967 | Seidler | 401/122 X |
| 3,692,417 | 9/1972 | Aston | 401/122 |
| 3,817,637 | 6/1974 | Vasas | 401/122 |
| 3,921,650 | 11/1975 | Montgomery | 132/218 |
| 3,925,843 | 12/1975 | Tsuruzawa et al. | 15/184 |
| 3,930,280 | 1/1976 | Vasas | 401/122 X |
| 4,390,298 | 6/1983 | Carluccio | 401/122 |
| 4,458,701 | 7/1984 | Holland | 132/218 |
| 4,470,425 | 9/1984 | Gueret | 401/122 X |
| 4,600,328 | 7/1986 | Clements | 401/18 |
| 4,796,647 | 1/1989 | Gueret | 401/122 X |
| 4,886,080 | 12/1989 | Cole . | |
| 4,972,858 | 11/1990 | Beck et al. . | |
| 5,048,547 | 9/1991 | Walker | 401/122 X |
| 5,180,241 | 1/1993 | Gueret | 401/122 |

FOREIGN PATENT DOCUMENTS

| | | | |
|---|---|---|---|
| 0236133 | 4/1987 | European Pat. Off. | 132/218 |
| 1310355 | 11/1962 | France | 132/216 |
| 820792 | 11/1951 | Germany . | |
| 2037409 | 7/1970 | Germany | 401/17 |
| 3240152 | 5/1984 | Germany . | |
| 3610007 | 3/1986 | Germany | 401/129 |
| 1315639 | 2/1973 | United Kingdom | 401/17 |
| 2064314 | 6/1981 | United Kingdom . | |

*Primary Examiner*—Steven A. Bratlie

*Attorney, Agent, or Firm*—Brumbaugh, Graves, Donohue & Raymond

[57] ABSTRACT

The invention provides a cosmetic apparatus for storing and applying cosmetic, particularly mascara to the eyelashes, comprising a container for holding the cosmetic, an applicator for applying the cosmetic to the user and an applicator wiper disposed within the container, near the vicinity of the opening of the container, the wiper comprising a plurality of projections for removing excess cosmetic from the applicator as the applicator is withdrawn from the container. The invention also provides a method for the storage and application of cosmetics contained within the container of the cosmetic apparatus.

15 Claims, 4 Drawing Sheets

APPLICATOR WIPER

This invention relates to an apparatus for the storage and application of cosmetics, and more particularly to an apparatus for the storage and application of mascara to the eyelashes.

BACKGROUND OF THE INVENTION

The development and widespread use of apparatuses for storage and application of mascara to the eyelashes have served to focus on the shortcomings and problems to be solved in the design of such apparatuses. Although there have been many improvements in their design, several problems have not been overcome.

One problem encountered is difficulty in applying the mascara to the brush and the eyelashes evenly. This difficulty is due partly to the tendency of the mascara to thicken in the container over periods of time. The thick mascara tends to accumulate on and stick to the applicator brush making it difficult to apply evenly.

Present mascara packaging incorporates a part that is commonly referred to as the "wiper". Generally, the wiper is formed by an orifice in the container. As the applicator brush bearing mascara is withdrawn from the reservoir containing the mascara, the applicator brush comes into contact with the rim of the orifice. This contact is intended to ensure that excess mascara is removed from the brush, preparing it for use.

A disadvantage of this method of removal is the fact that the wiping action by the rim of the orifice tends to strip all mascara from the tips of the bristles of the brush, leaving the central portion of the brush loaded with mascara. Thus, when the brush is applied to the eyelashes, the eyelashes are deflected by the bristle tips and fail to contact the mascara.

Another disadvantage of the device described above is the tendency of the orifice wiper to leave a tail or 'blob' of mascara suspended from the tip of the applicator. This blob has to be removed before the applicator brush is applied to the eyelashes.

Yet another disadvantage of circular orifice wipers is their inability to evenly wipe brushes with asymmetrical, contoured or otherwise varied profiles. Thus, brushes that have a change in profile either radially or axially tend to be primed with mascara in a non-uniform distribution.

A further problem results from the tendency of the orifice wipers, presently in use, to strip large clumps of dried or caked mascara from the applicator when the applicator is re-inserted into the reservoir. These clumps accumulate on the wiper and are frequently picked up by the brush when the brush is subsequently removed from the reservoir. These clumps interfere with the smooth application of liquid mascara onto the eyelashes. Further, these clumps are frequently pushed down by the applicator or migrate from the bristles into the reservoir, contaminating and degrading the quality of the mascara in the reservoir.

The present invention solves the long-felt problems and fulfills all the attendant needs existing in the field of the invention as discussed above. The present invention is directed to a device which ensures that mascara is thinly and evenly distributed on the applicator brush, the blob of mascara is removed from the tip and clumps of mascara are prevented from forming on, reaching or accumulating on the applicator brush. In this way, a thin and even coating of mascara can be applied to the eyelashes every time the brush is withdrawn from the reservoir for use.

SUMMARY OF THE INVENTION

The invention provides a cosmetic apparatus for use in the application of cosmetic, especially mascara to the eyelashes. A cosmetic container is provided with at least one open end, the open end capable of receiving a cosmetic applicator. The applicator is a rod, the first end of which is designed to be inserted into the open end of the cosmetic container so that it contacts the cosmetic in the reservoir of the container. The first end captures cosmetic thereon while within the container and is used to apply the cosmetic to the user after the applicator is removed from the container. The second end of the applicator comprises a handle or a means for capping the opening of the container. An applicator wiper means is disposed on the inner side of the container, preferably near the vicinity of the opening, the wiper comprising a plurality of projections extending into the container's cavity where the projections preferably form an area through which the applicator is pulled upon removal. Any excess cosmetic on the applicator is removed by interaction between the wiper and the applicator as the applicator is withdrawn from the container through the wiper.

The invention provides a method for the application of cosmetics, especially mascara to the eyelashes, comprising the steps of providing a container for holding cosmetics, providing at least one applicator having a first end for capturing cosmetics thereon while within the container and for the application of cosmetic to the user, and an applicator wiper disposed within the container, the wiper comprising a plurality of projections extending into the container's cavity where the projections form an area through which the applicator is passed upon removal. When the applicator is withdrawn from the container through the wiper, any excess cosmetics on the applicator is removed.

The applicator is re-inserted into the container between uses, the first end of the applicator first contacting the projections of the wiper, the projections removing residual cosmetic from the applicator, and the first end of the applicator then contacting the cosmetic within the container.

BRIEF DESCRIPTION OF THE DRAWING

The foregoing objects, features and advantages of the present invention will be understood more fully from the following detailed description thereof when taken in conjunction with the appended drawings of which.

Where possible, like elements in the figures have been denoted with like reference numerals.

DETAILED DESCRIPTION OF THE INVENTION

Figure 1:
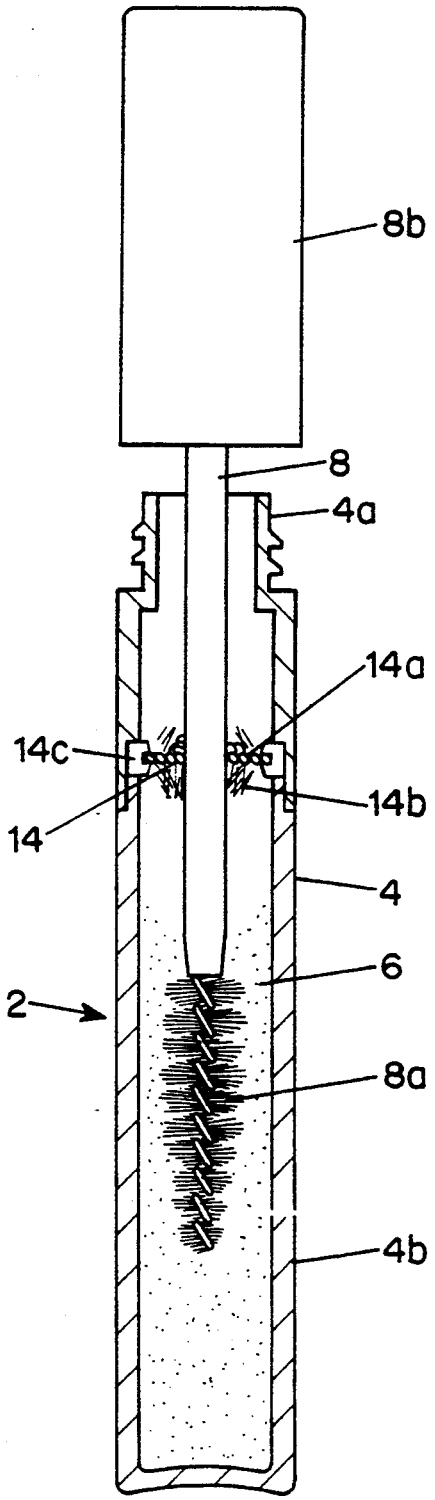
FIG. 1 is a longitudinal cross-sectional view of the cosmetic apparatus of the invention where the cosmetic applicator is almost completely inserted into the container, depicting the first end of the applicator within the reservoir of the container.

The present invention is directed to a cosmetic apparatus for use in the storage and the application of a cosmetic, particularly mascara to the eyelashes. The cosmetic apparatus comprises a container, at least one applicator and an applicator wiper.

The container may be fashioned to any shape. As shown in the Figures, the preferred embodiments are cylindrical. One embodiment (See FIGS. 1–4, 7 & 8) has a cylindrical reservoir portion for holding the cosmetic and a narrower neck portion situated between the reservoir portion and the opening of the container. A cylindrical container may, however, not have a discrete narrowed neck portion i.e. the neck may have the same diameter as the reservoir of the container. The container may also have a plurality of openings to accommodate a plurality of applicators.

The applicator of the invention is a rod with a first end modified to capture and apply cosmetic. The first end of the preferred embodiment is equipped with a brush or a set of bristles. The first end may also be modified to form a tubular structure made of, for example, sponge or foam. The second end of the rod lies outside the container and preferably is modified to provide the means for closing the container, for example a cap having a screw-on mechanism on its inner surface which engages with a corresponding mechanism on the outer surface of the neck of the container, when the cosmetic applicator is completely inserted into the container.

The applicator brush of the invention is disposed in its resting position in the container, the distance from the opening depending of course on the length of the rod. The wiper may extend down onto the entire inner surface of the neck or only a portion thereof. If the container does not have a discrete neck portion, the wiper may extend along the inner surface of the container for distances which may vary from one embodiment to another.

The wiper comprises a plurality of projections extending into the cavity, preferably from the inner wall of the container. The wiper may be integral to the inner wall of the container or, alternatively, the wiper may be an insert, with the outer surface of the wiper attached to the inner surface of the container. The wiper of the preferred embodiment is a brush comprising a standard twisted wire shaft brush wherein the shaft has been formed into a ring or helix, which is inserted within the opening of the container and attached to the inner wall of the container. The bristles of the wiper are attached to the shaft and project substantially perpendicularly from the inner wall of the container. Preferably, the diameter of the wiper is such that the first end of the applicator brush passes comfortably within the helix or loop of the brush wiper's shaft. The bristles of the wiper brush may cross at the center of the helix or loop. Alternatively, the bristles may be of a shorter length, allowing no cross-over or even failing to meet in the center. The wipers described above function in accordance with the invention provided that the diameter of any longitudinal space in the center of the helix or loop of the wiper is less than the diameter of the applicator shaft.

The bristles of the wiper brush are flexible. When the applicator is withdrawn from the reservoir of mascara through the wiper, the bristles of the wiper interact individually with the bristles of the applicator brush and directly with the applicator shaft, leaving any excess mascara in the container. This results in the even and uniform distribution of mascara over the bristles of the applicator brush regardless of the applicator brush's shape or profile. An adequate amount of mascara remains on the tips of the bristles, and many fine webs of mascara that radiate outwardly from the shaft of the brush to the tips of the bristles are strung axially from one row of bristles to the next. Very little mascara remains on the shaft of the applicator.

When the applicator is reintroduced into the reservoir, the brush wiper effectively removes dried or caked mascara by the interaction of the bristles of the applicator brush and the bristles of the wiper brush. This results in the dried mascara being removed and broken up by the wiper's bristles into a fine dust, rather than large clumps. This dust may uniformly thicken the mascara somewhat in the reservoir, and the mascara then forms a thicker film on the eyelash. The applicator wiper allows uniform distribution of mascara on the first end of the applicator, so that the mascara is more effectively applied to the eyelashes, the unwanted mascara tail is automatically removed from the tip of the applicator and the old mascara is effectively removed from the brush by inhibiting the generation of clumps.

The projections of the wiper may also be barbed structures, twisted wires or frusta, placed serially one upon the other at sufficient intervals to act as individual projections for interacting with the bristles of the applicator brush. The projections are made of materials which are well known to those skilled in the art to be used for that purpose. Nylon, metallic wire, plastic, rubber and various copolymers which may be twisted into various shapes, are examples of such materials; the hook side of VELCRO (a registered trademark) may also be used. The projections are arranged to form at least one ring on the inner surface of the container preferably in the vicinity of the opening.

An exemplary embodiment may be seen in FIG. 1, which shows a cosmetic apparatus 2 comprising a container 4 having a neck portion **4*a* and a reservoir portion 4*b* for storing a quantity of cosmetic such as mascara 6. The container 4 is preferably cylindrical in shape as depicted. An applicator 8 extends axially into the container through an opening at one end, so that one end 8*a* of the applicator contacts the mascara 6 in the reservoir 4*b* and the opposite end of the applicator is a cap 8*b* that screws onto the neck 4***a* of the container in the closed position. The interior surface of the container is provided with a wiper 14 which has a helical or ring-shaped shaft 14*a* fixedly attached to the interior surface of the container by attachment means 14*c*.

Figure 2:
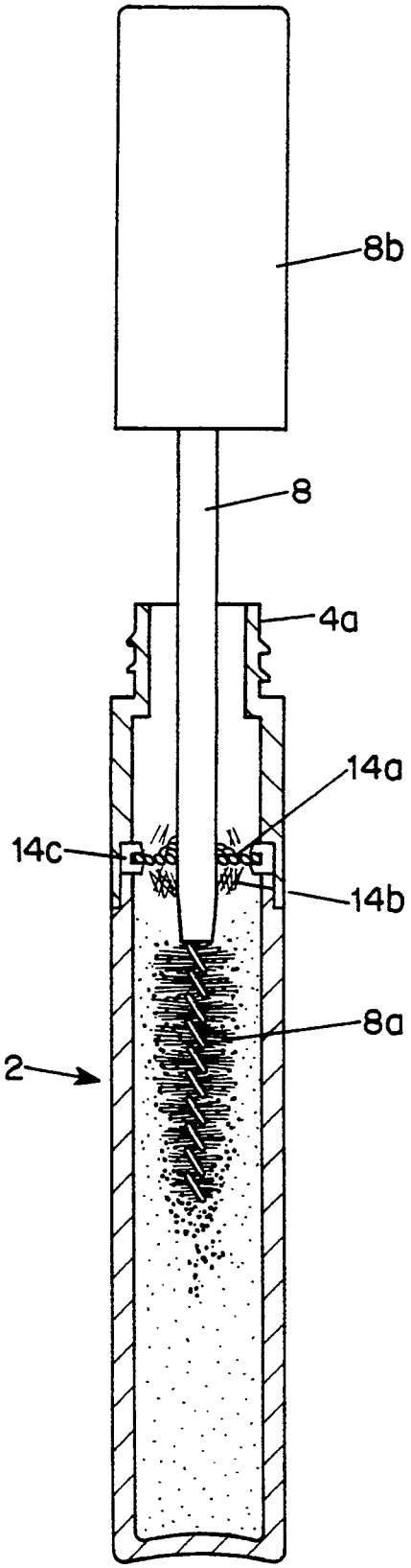
FIG. 2 is a longitudinal cross-sectional of the cosmetic apparatus depicting an applicator which has been partially withdrawn from the container.

Referring to FIG. 2, the cosmetic apparatus 2 is shown with the applicator 8 partially withdrawn from the container. The external surface of the neck portion 4*a* of the container 4 bears external threads. The inner surface of the cap 8*b* is provided with internal threads (not shown) which are designed to engage with the external threads of the neck 4*a*, so that the cap 8*b* may be rotatably fastened to container 4 in a screw-on fashion.

Figure 3:
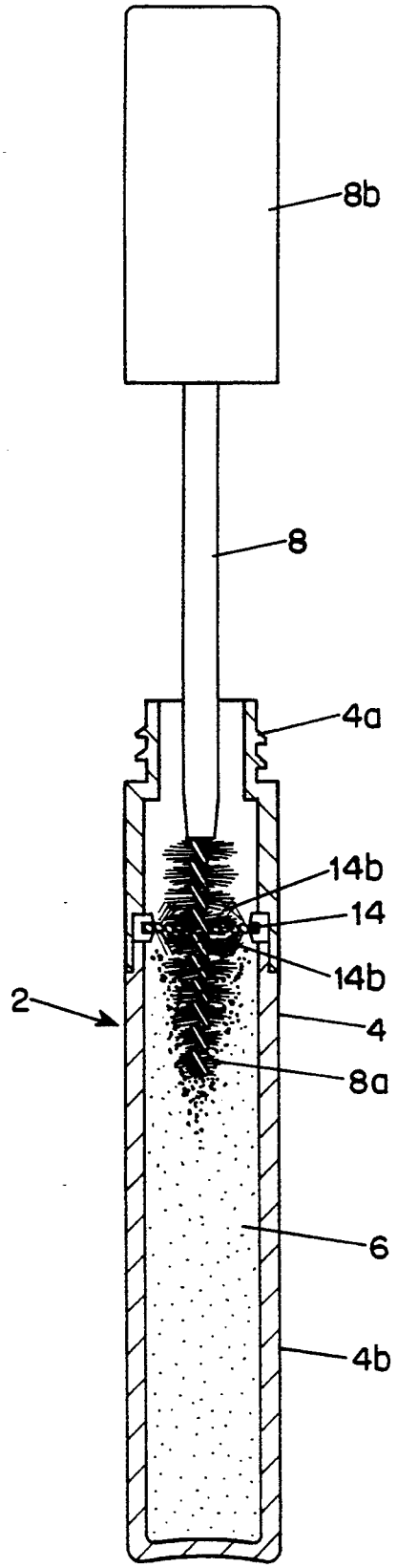
FIG. 3 is a longitudinal cross-sectional view of the cosmetic apparatus as shown in FIG. 1, depicting the intermingling of the brush bristles and the wiper bristles as the brush passes through the wiper.

Referring to FIG. 3, the bristles 8*a* of the brush can be seen to be loaded with mascara prior to passing through and intermingling with the bristles 14*b* of the wiper 14. The bristles of the brush that have passed through the wiper bristles are seen to bear a uniform layer of mascara, the excess mascara having been removed by the wiper bristles 14*b*.

Figure 4:
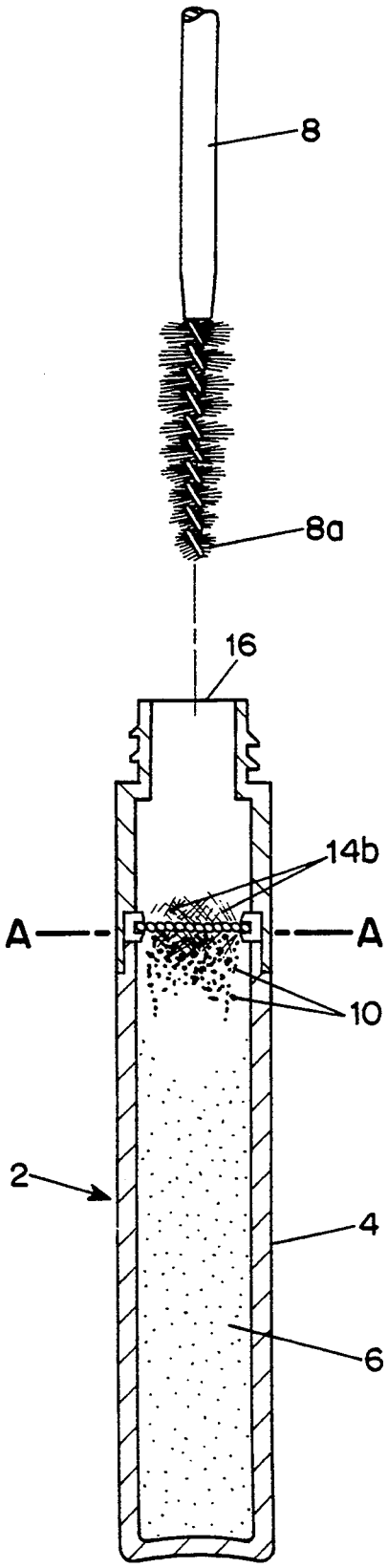
FIG. 4 is a longitudinal cross-sectional view of the cosmetic apparatus with the applicator completely withdrawn from the container, showing the brush bearing an even layer of mascara, the excess mascara and mascara tail having been removed by the wiper, as shown.
Figure 4A:
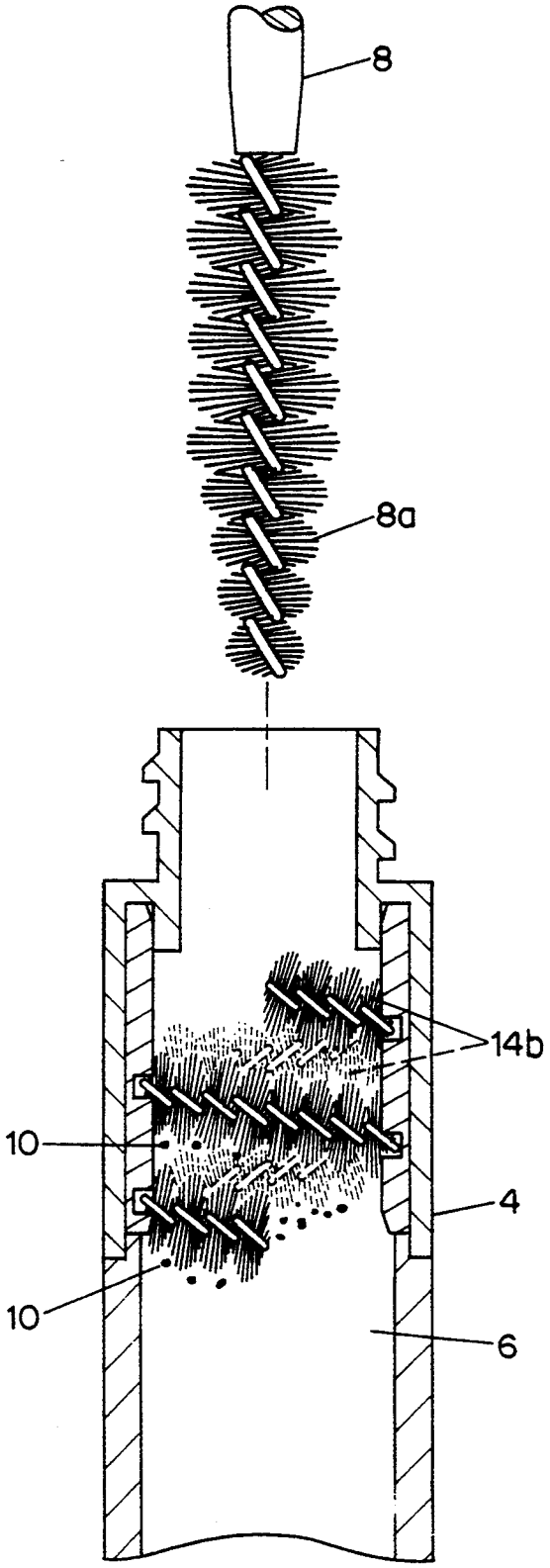

Referring to FIG. 4, the cosmetic apparatus 2 is shown with the applicator 8 completely withdrawn from the container 4. Flexible bristles 14*b* are attached to the shaft 14*a*. The length of the bristles determines whether the bristles cross each other or leave a longitudinal space through the center of the wiper. To be effective, the space in the center of the wiper must be smaller than the diameter of the first end of the applicator, so that when the applicator is withdrawn from the reservoir through the wiper, the bristles of the wiper interact with the first end of the applicator. The free ends of the flexible bristles 14*b* are pointing towards the opening 16 of the container, being pushed in this direction by the interaction of the end 8*a* of the applicator with the bristles 14*b* of the wiper 14 during withdrawal of the applicator 8 from the container 4. The brush bristles 8*a* can be seen to bear an even layer of mascara and the tip of the brush has no mascara tail. Clumps of excess mascara 10, can be seen on, and in the vicinity of, the bristles 14*b* of the wiper.

Figure 5:
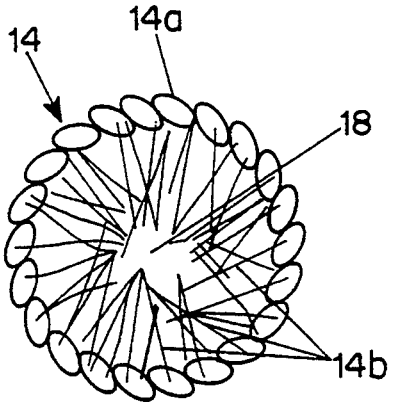
FIG. 5 is a horizontal cross-sectional view along the line A—A on FIG. 4, after the applicator has been totally withdrawn from the container.

Referring to FIG. 5, a cross-section of the wiper 14 of the invention as shown in FIG. 4 is demonstrated, the wiper 14 having bristles 14*b* of a length such that the free ends of bristles placed opposite each other do not meet in the center of the cavity, thus leaving a central space 18 extending longitudinally through the center of the wiper 14, and through which the applicator 8 passes, the diameter of the space being less than the diameter of the applicator 8. The shaft 14*a* of the wiper 14 shown may be made out of a hollow or solid fiber brush, and is formed into a ring or helix.

Figure 6:
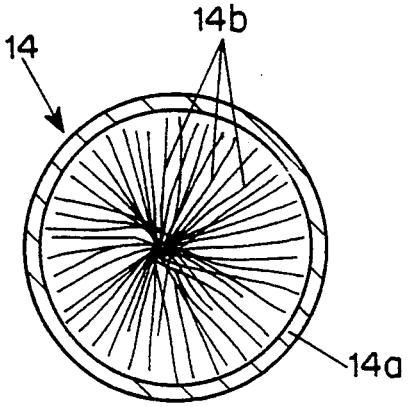
FIG. 6 is a horizontal cross-sectional view of another embodiment of the wiper along the line A—A on FIG. 4, after the applicator has been totally withdrawn from the container, wherein the bristles of the wiper brush meet or even cross over part of each other, leaving no central space in the wiper.

Referring to FIG. 6, a cross-section of another embodiment of the wiper 14 is shown, wherein the flexible bristles 14*b* are longer, so that the free ends of the bristles attached at opposite points of the shaft 14*a* overlap, leaving no central longitudinal space.

Figure 7:
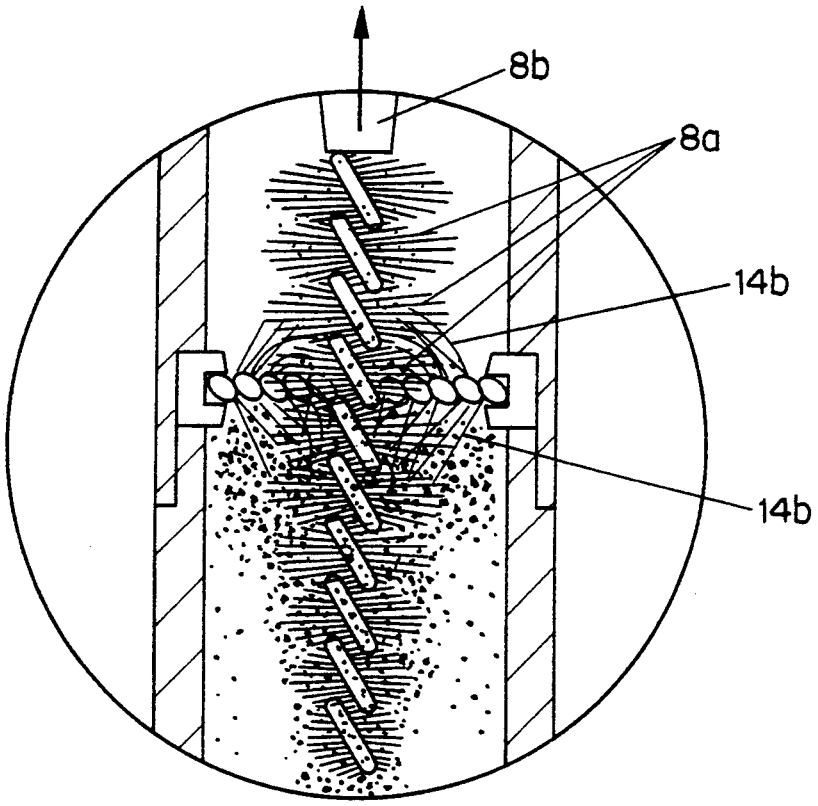
FIG. 7 is an exploded view of the wiper area shown in FIG. 3, showing the relationship of the bristles of the wiper and the bristles of the brush.

Referring to FIG. 7, the relationship between the brush bristles 8*a* and wiper bristles 14*b* is shown as the brush passes through the wiper.

Figure 8:
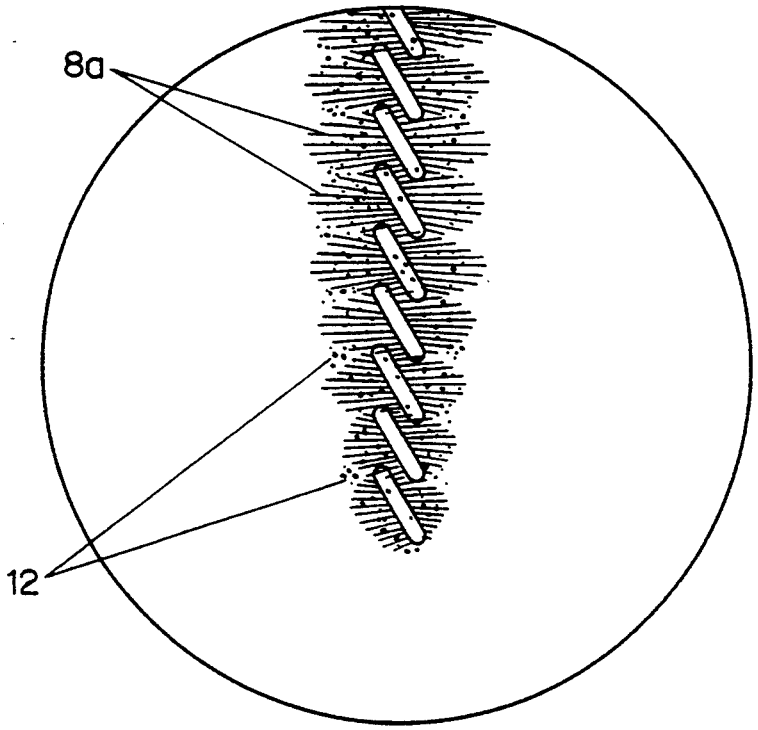
FIG. 8 is an exploded view of the free end of the brush shown in FIG. 4, showing the uniform distribution of mascara on the brush, and the absence of a mascara tail at the tip of the brush.

Referring to FIG. 8, the brush bristles 14*b* are seen to bear an even distribution of mascara and mascara webs 12, after the brush has been withdrawn from the container. Further, there is no mascara tail at the tip of the brush.

It should be noted that the specific embodiments shown here are is for illustration purposes only, and not for purpose of limitation. Many modifications may be made by one skilled in the art to the mechanism detailed above while using the same principles explained within the teaching of the specification. These examples are not intended to mean that all possible modifications have been outlined.

We claim:

1. A cosmetic apparatus for use in the application of mascara to eyelashes, comprising:

a container having a cavity for holding mascara, said container having at least one opening;

at least one applicator having a first end comprising a first plurality of bristles for capturing mascara thereon while the applicator is within the container and for the application of the mascara to the user and having a second end comprising a means for handling the applicator;

an applicator wiper disposed along the inner surface of the container, the wiper comprising a second plurality of bristles extending into the cavity and forming an area through which the applicator is passed when the applicator is removed from the container, whereby said first plurality of bristles commingle with said second plurality of bristles causing any clumps of or excess mascara on the applicator to be pulverized or removed when the applicator is withdrawn from the container through the wiper.

2. The cosmetic apparatus according to claim 1, wherein the second end of the applicator further comprises a means for capping the opening of the container.

3. The cosmetic apparatus according to claim 1, wherein the applicator wiper is disposed on the inner surface of the container.

4. The cosmetic apparatus according to claim 1, wherein the applicator wiper is disposed near the vicinity of the opening of the container.

5. The cosmetic apparatus according to claim 1, wherein the plurality of bristles extend from the wall of the container into the cavity.

6. The cosmetic apparatus according to claim 1, wherein the wiper is integral to the inner wall of the container.

7. The cosmetic apparatus according to claim 1, wherein the wiper is an insert whose outer surface is fixedly attached to the inner surface of the container so as to define a bore of a diameter which is smaller than the diameter of the applicator, whereby the first end of the applicator engages said wiper to remove excess mascara therefrom when the applicator is withdrawn from the container through the wiper.

8. The cosmetic apparatus according to claim 1, wherein at least one ring of bristles are within the container adjacent to the orifice.

9. The cosmetic apparatus according to claim 1 wherein the bristles are arranged in a helical distribution.

10. The cosmetic apparatus according to claim 1 wherein the bristles are arranged to form at least one ring, the projections being substantially perpendicular to the inner wall of the container.

11. The cosmetic apparatus according to claim 1 wherein the bristles extend along a portion of the inner wall of the container.

12. The cosmetic apparatus according to claim 1, wherein the free ends of the bristles attached at one point on the inner wall of the container overlap those attached at an opposite point on the inner wall in the cavity.

13. A cosmetic apparatus according to claim 1 wherein the container is cylindrical.

14. A method for the application of cosmetics comprising the steps of:

(a) providing a container having a cavity for holding mascara;

(b) providing at least one applicator having a first end comprising a first plurality of bristles for capturing mascara thereon while within the container and for the application of mascara to the user;

(c) providing an applicator wiper disposed within the container, the wiper comprising a second plurality of bristles extending from the wall of the container into the cavity and forming an area through which the applicator is passed when the applicator is removed from the container, whereby said first plurality of bristles commingle with said second plurality of bristles causing any clumps of or excess mascara on the applicator to be pulverized or removed when the applicator is withdrawn from the container through the wiper.

15. The method according to claim 14, further comprising the step of:

re-inserting the applicator into the container, the first end of the applicator first contacting the second plurality of bristles, the second plurality of bristles removing residual mascara from the applicator, the first end of the applicator then contacting the mascara within the container.

* * * * *

UNITED STATES PATENT AND TRADEMARK OFFICE

CERTIFICATE OF CORRECTION

PATENT NO. : 5,397,193

DATED : March 14, 1995

INVENTOR(S) : Kirk, III et al.

It is certified that error appears in the above-indentified patent and that said Letters Patent is hereby corrected as shown below:

Column 6, line 51, "claim 1" should read -- claim 7 --.

Signed and Sealed this

Sixth Day of June, 1995

Bruce Lehman

*Attest:*

BRUCE LEHMAN

*Attesting Officer*

*Commissioner of Patents and Trademarks*